US007382211B2

(12) United States Patent
Kishimoto et al.

(10) Patent No.: US 7,382,211 B2
(45) Date of Patent: Jun. 3, 2008

(54) NON-RECIPROCAL CIRCUIT DEVICE

(75) Inventors: Yasushi Kishimoto, Tottori-ken (JP); Takefumi Terawaki, Tottori-ken (JP); Minoru Nozu, Tottori-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 139 days.

(21) Appl. No.: 11/174,581

(22) Filed: Jul. 6, 2005

(65) Prior Publication Data

US 2006/0028286 A1 Feb. 9, 2006

(30) Foreign Application Priority Data

Jul. 7, 2004 (JP) ..... 2004-200187
Mar. 30, 2005 (JP) ..... 2005-098231

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 6,222,425 B1 * 4/2001 Okada et al. ..... 333/1.1
2004/0004521 A1 1/2004 Hasegawa

FOREIGN PATENT DOCUMENTS

| | | |
|---|---|---|
| EP | 1 276 168 A | 1/2003 |
| EP | 1 309 031 A | 5/2003 |
| EP | 1 246 292 A | 10/2003 |
| JP | 09-232818 | 9/1997 |
| JP | 2004-088743 | 3/2004 |

* cited by examiner

*Primary Examiner*—Stephen E Jones
(74) *Attorney, Agent, or Firm*—Sughrue Mion, PLLC

(57) ABSTRACT

A non-reciprocal circuit device comprising a first inductance element disposed between a first input/output port and a second input/output port, a second inductance element disposed between the second input/output port and a ground, a first capacitance element constituting a first parallel resonance circuit with the first inductance element, a second capacitance element constituting a second parallel resonance circuit with the second inductance element, a resistance element parallel-connected to the first parallel resonance circuit, and an impedance-adjusting means disposed between the first input/output port and the first inductance element.

8 Claims, 15 Drawing Sheets

NON-RECIPROCAL CIRCUIT DEVICE

FIELD OF THE INVENTION

The present invention relates to a non-reciprocal circuit device having non-reciprocal transmission characteristics to high-frequency signals, particularly to a non-reciprocal circuit device generally called isolator, which is used in mobile communications systems such as cell phones, etc.

BACKGROUND OF THE INVENTION

Non-reciprocal circuit devices such as isolators, etc. are widely used in mobile communications equipment utilizing frequency bands from several hundreds of MHz to ten-odd GHz, such as cell phones and their bases, etc. An isolator is disposed between a power amplifier and an antenna, for instance, in a transmission part of mobile communications equipment, to prevent unnecessary signals from flowing back to the power amplifier and stabilize the impedance of the power amplifier on a load side. Accordingly, the isolator is required to have excellent insertion loss characteristics, reflection loss characteristics and isolation characteristics.

FIG. 27 shows a conventional isolator. This isolator comprises a microwave ferrite 38 made of a ferrimagnetic material, three central conductors 31, 32, 33 disposed on a main surface of the ferrite 38 such that they are crossing at an angle of 120° in a mutually insulated state, matching capacitors C1-C3 each connected to one end of each central conductor 31, 32, 33, and a terminal resistor Rt connected to a port (for instance, P3) of any one of the central conductors 31, 32, 33. The other end of each central conductor 31, 32, 33 is grounded. A DC magnetic field Hdc is applied from a permanent magnet (not shown) to the ferrite 38 in its axial direction. In this isolator, a high-frequency signal input through the port P1 is transmitted to a port P2, and reflected waves from the port 2 are absorbed by the terminal resistor Rt, and therefore not transmitted to the port P1. Thus, unnecessary reflected waves generated by the impedance variations of the antenna are prevented from flowing back to the power amplifier, etc.

Recently proposed is an isolator with a different equivalent circuit from that of the above isolator, which has excellent insertion loss and reflection loss characteristics (JP 2004-88743 A). This isolator having two central conductors is called "two-terminal-pair isolator." An equivalent circuit of its basic structure is shown in FIG. 24. This two-terminal-pair isolator comprises a first central electrode (first inductance element) L1 disposed between a first input/output port P1 and a second input/output port P2, a second central electrode (second inductance element) L2 disposed between the second input/output port P2 and a ground such that it is crossing the first central electrode L1 in an electrically insulated state, a first capacitance element C1 disposed between the first input/output port P1 and the second input/output port P2 for constituting a first parallel resonance circuit with the first central electrode L1, a resistance element R, and a second capacitance element C2 disposed between the second input/output port P2 and the ground for constituting a second parallel resonance circuit with the second central electrode L2.

A frequency at which isolation (reverse attenuation) is at maximum is set in the first parallel resonance circuit, and a frequency at which insertion loss is at minimum is set in the second parallel resonance circuit. When a high-frequency signal is transmitted from the first input/output port P1 to the second input/output port P2, the first parallel resonance circuit between the first input/output port P1 and the second input/output port P2 is not resonated, but the second parallel resonance circuit is resonated, resulting in small transmission loss (excellent insertion loss characteristics). Current flowing from the second input/output port P2 back to the first input/output port P1 is absorbed by the resistance element R between the first input/output port P1 and the second input/output port P2.

FIG. 25 shows a specific example of the structure of the two-terminal-pair isolator. The two-terminal-pair isolator 1 comprises casings (upper casing 4 and lower casing 8) made of a ferromagnetic metal such as soft iron, etc. for forming a magnetic circuit, a permanent magnet 9, a central conductor assembly 30 comprising a microwave ferrite 20 and central conductors 21, 22, and a laminate substrate 50, on which the central conductor assembly 30 is mounted.

The upper casing 4 for containing the permanent magnet 9 substantially has a box shape having an upper portion 4*a* and four side portions 4*b*, and the lower casing 8 has a U-shape having a bottom portion 8*a* and two side portions 8*b*, 8*b*. Each casing 4, 8 is plated with conductive metals such as Ag, Cu, etc.

The central conductor assembly 30 comprises a disk-shaped microwave ferrite 20, and first and second central conductors 21, 22 disposed on an upper surface of the microwave ferrite 20 such that they are perpendicularly crossing each other via an insulation layer (not shown), the first and second central conductors 21, 22 being electromagnetically coupled at a cross. The first and second central conductors 21, 22 are respectively constituted by two strip lines, and both end portions 21*a*, 21*b*, 22*a*, 22*b* of each line are separate from each other and extend onto a bottom surface of the microwave ferrite 20.

FIG. 26 shows the structure of the laminate substrate 50. The laminate substrate 50 comprises a sheet 46*a* having electrodes 51-54 connected to the ends of the central conductors 21, 22 on a rear surface, a dielectric sheet 41 having capacitor electrodes 55, 56 and a resistor 27 on a rear surface, a dielectric sheet 42 having a capacitor electrode 57 on a rear surface, a dielectric sheet 43 having a ground electrode 58 on a rear surface, and a dielectric sheet 45 having an input external electrode 14, an output external electrode 15 and ground external electrodes 16, etc.

The central-conductor-connecting electrode 51 corresponds to the first input/output port P1, the central-conductor-connecting electrode 52 corresponds to the third port P3, and the central-conductor-connecting electrodes 53, 54 correspond to the second input/output port P2 in the above equivalent circuit. One end 21*a* of the first central conductor 21 is connected to the input external electrode 14 via the first input/output port P1 (central-conductor-connecting electrode 51). The other end 21*b* of the first central conductor 21 is connected to the output external electrode 15 via the second input/output port P2 (central-conductor-connecting electrode 54). One end 22*a* of the second central conductor 22 is connected to the output external electrode 15 via the second input/output port P2 (central-conductor-connecting electrode 53). The other end 22*b* of the second central conductor 22 is connected to the ground external electrode 16 via the third port P3 (central-conductor-connecting electrode 52). The first capacitance element C1 (25) is connected between the first input/output port P1 and the second input/output port P2, to form the first parallel resonance circuit with the first central conductor L1 (21). The second capacitance element C2 (26) is connected between the second input/output port P2 and the third port P3, to form the second parallel resonance circuit with the second central conductor L2 (22).

To obtain a non-reciprocal circuit device having excellent electric characteristics, various factors providing inductance generated by lines connecting reactance elements, floating capacitance generated by interference between electrode patterns, etc., should be taken into consideration.

It is likely in the above two-terminal-pair isolator that unnecessary reactance components are connected to the first and second parallel resonance circuits. If that happens, the input impedance of the two-terminal-pair isolator is deviated from a desired level, resulting in impedance mismatching with other circuits connected to the two-terminal-pair isolator, and thus the deterioration of insertion loss characteristics and isolation characteristics.

Though the inductance and capacitance of the first and second parallel resonance circuits can be determined by taking unnecessary reactance components into consideration, simple changing of the width and gap, etc. of lines constituting the first and second central conductors 21, 22 would fail to obtain optimum matching conditions with external circuits. This is because the mutual coupling of the first and second central conductors 21, 22 changes the inductance of the first and second inductance elements L1, L2, resulting in difficulty in independently adjusting input impedance at the first and second input/output ports P2, P1. Particularly the deviation of input impedance at the first input/output port P1 should be prevented because it leads to increase in insertion loss.

OBJECT OF THE INVENTION

Accordingly, an object of the present invention is to provide a non-reciprocal circuit device having excellent insertion loss characteristics and isolation characteristics as well as an easily adjustable input impedance.

DISCLOSURE OF THE INVENTION

The non-reciprocal circuit device of the present invention comprises a first inductance element disposed between a first input/output port and a second input/output port, a second inductance element disposed between the second input/output port and a ground, a first capacitance element constituting a first parallel resonance circuit with the first inductance element, a second capacitance element constituting a second parallel resonance circuit with the second inductance element, a resistance element parallel-connected to the first parallel resonance circuit, and an impedance-adjusting means disposed between the first input/output port and the first inductance element.

The impedance-adjusting means is preferably constituted by an inductance element and/or a capacitance element, or by a lowpass filter or a highpass filter. An inductance element is preferably disposed between the second parallel resonance circuit and a ground. Further, a capacitance element is preferably connected in parallel to the inductance element between the second parallel resonance circuit and a ground.

The first and second inductance elements are preferably formed by a first central conductor and a second central conductor disposed on a ferrimagnetic member. At least part of the first or second capacitance element is preferably formed by an electrode pattern in the laminate substrate. The inductance element and/or the capacitance element for the impedance-adjusting means are preferably constituted by electrode patterns in the laminate substrate, or elements mounted onto the laminate substrate.

BRIEF DESCRIPTION OF THE DRAWINGS

FIG. 9(*b*) is a perspective view showing the central conductor shown in FIG. 9(*a*), which is in an assembled state;

DESCRIPTION OF BEST MODE OF THE INVENTION

Figure 1:
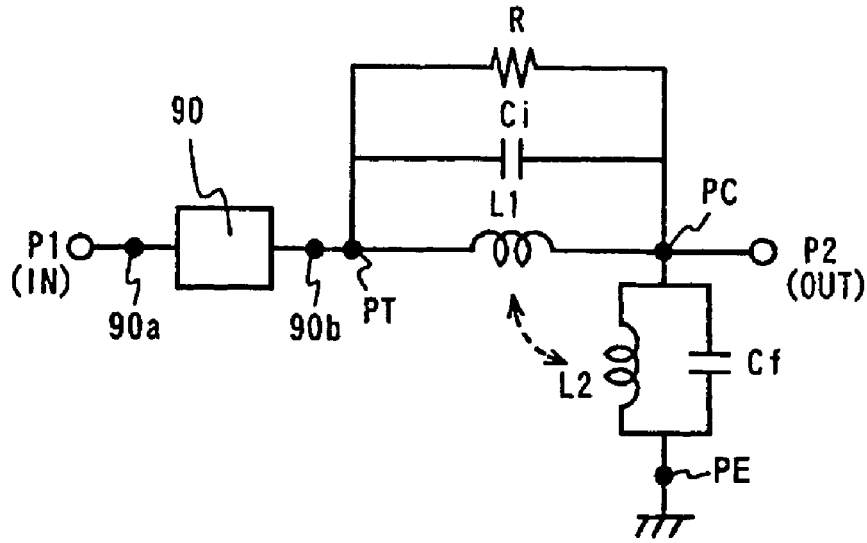
FIG. 1 is a view showing an equivalent circuit of a non-reciprocal circuit device according to one embodiment of the present invention.
Figure 2:
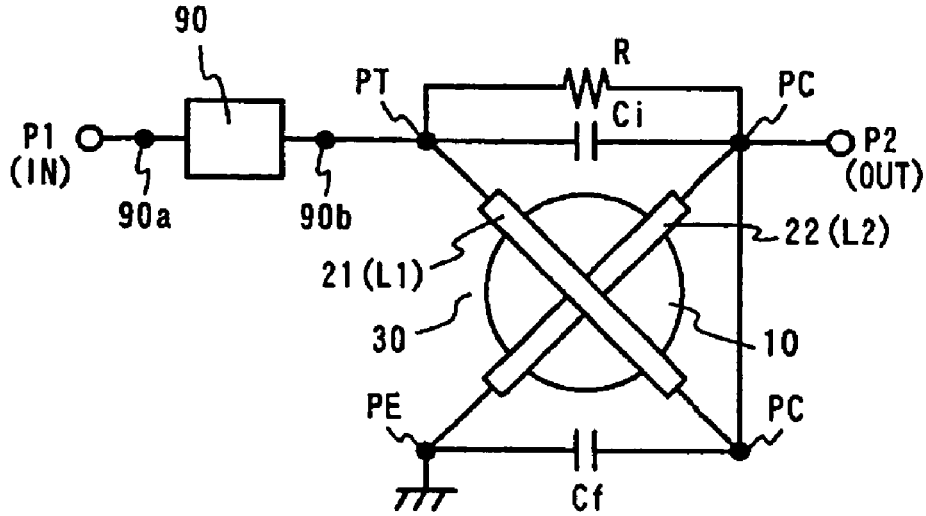
FIG. 2 is a view showing an equivalent circuit of a non-reciprocal circuit device according to one embodiment of the present invention.

FIG. 1 shows an equivalent circuit of the non-reciprocal circuit device according to one embodiment of the present invention. This non-reciprocal circuit device is a two-terminal-pair isolator having a first input/output port P1 and a second input/output port P2, which comprises a first inductance element L1 connected between a port PT and a port PC, a second inductance element L2 connected between the port PC and a port PE, a first capacitance element Ci connected between the port PT and the port PC for constituting a first parallel resonance circuit with the first inductance element L1, a second capacitance element Cf connected between the port PC and the port PE for constituting a second parallel resonance circuit with the second inductance element L2, a resistance element R connected between the port PT and the port PC, and an impedance-adjusting means 90 connected between the first input/output port P1 and the port PT. The port PE is grounded. As shown in the equivalent circuit of FIG. 2, the first and second inductance elements L1, L2 are constituted by first and second central conductors 21, 22 disposed on the ferrimagnetic member.

Figure 3:
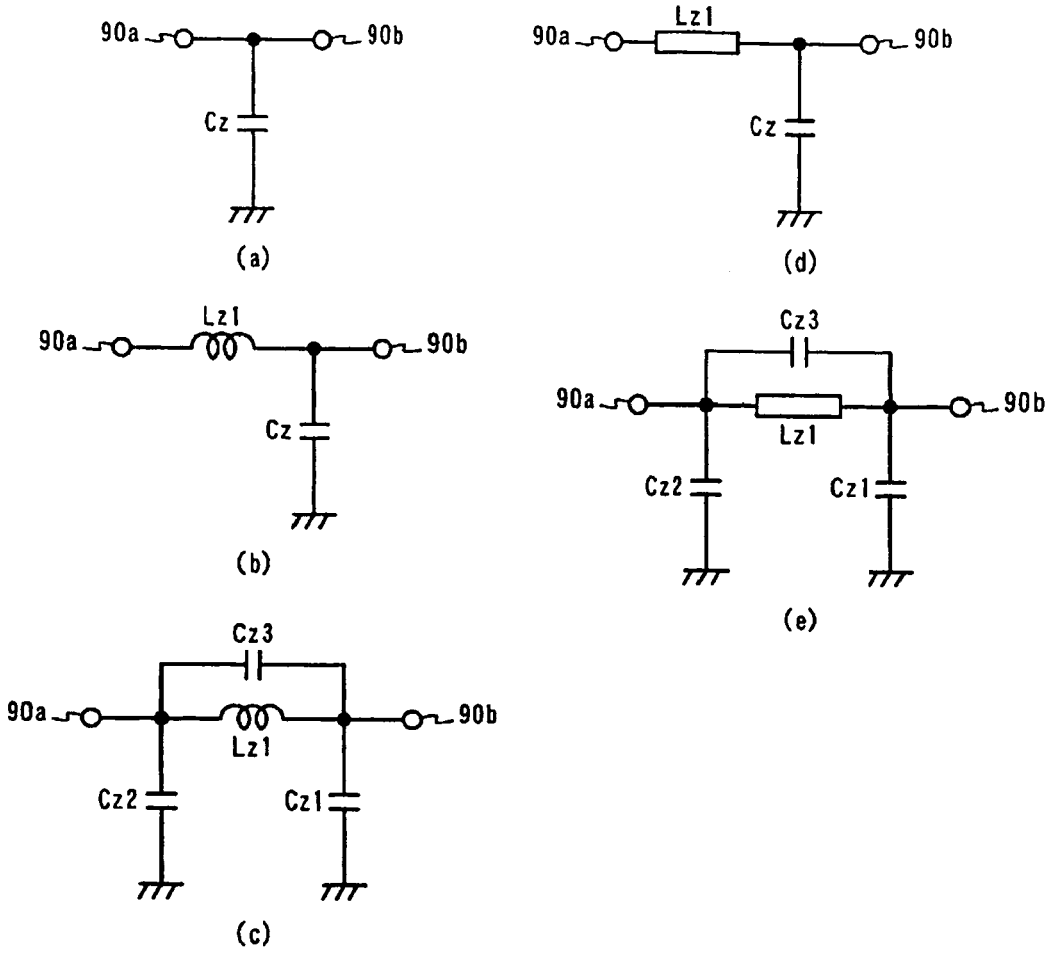
FIG. 3 is a view showing equivalent circuits of various examples of impedance-adjusting means used in the non-reciprocal circuit device according to one embodiment of the present invention.
Figure 4:
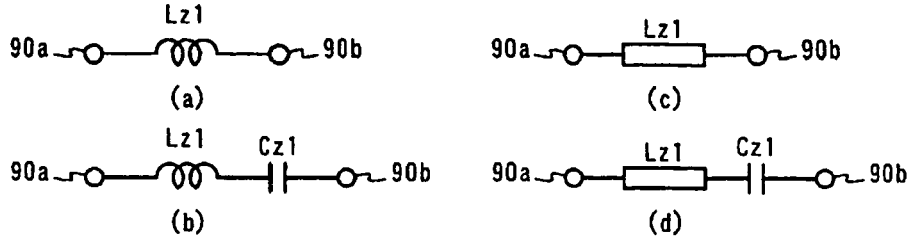
FIG. 4 is a view showing equivalent circuits of various examples of impedance-adjusting means used in the non-reciprocal circuit device according to one embodiment of the present invention.
Figure 5:
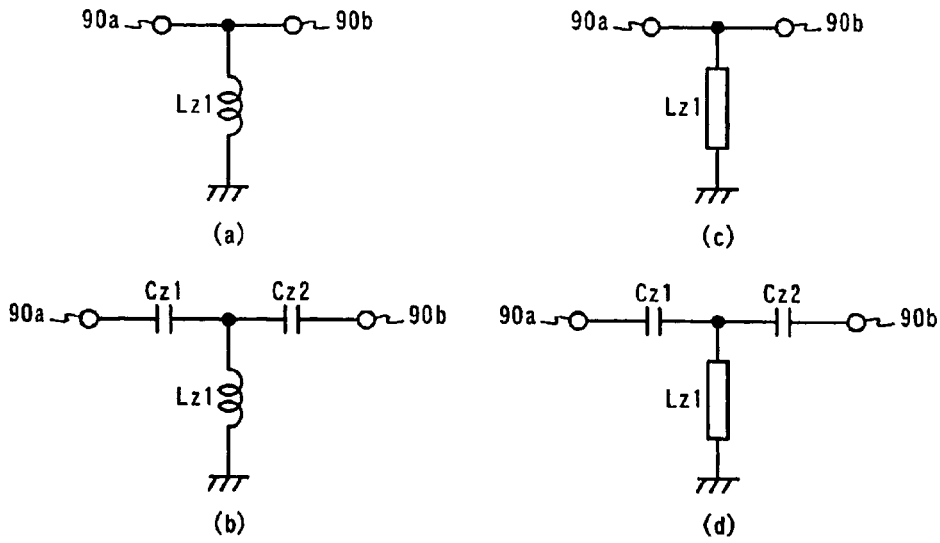
FIG. 5 is a view showing equivalent circuits of various examples of impedance-adjusting means used in the non-reciprocal circuit device according to one embodiment of the present invention.

FIGS. 3-5 show various examples of the impedance-adjusting means 90. The impedance-adjusting means 90 is constituted by a third inductance element and/or a third capacitance element. The impedance-adjusting means 90 may be properly selected depending on whether the input impedance of the port PT is inductive or capacitive. For instance, when the input impedance of the two-terminal-pair isolator is inductive when viewed from the port PT, the impedance-adjusting means 90 used should have capacitive input impedance. On the contrary, when the input impedance is capacitive, the use of the impedance-adjusting means 90 having inductive input impedance can achieve the desired impedance matching. The inductance element and the capacitance element are preferably constituted by chip parts, which can be easily handled and have easily changeable constants. The inductance element may be formed by a distribution constant line.

When the impedance-adjusting means 90 is constituted by a lowpass filter, its impedance can be easily adjusted without changing the first and second inductance elements L1, L2 and the first and second capacitance elements Ci, Cf, and it can remove unnecessary frequency components (harmonic signals) such as second and third harmonics supplied from a power amplifier.

The power amplifier achieves impedance matching at a fundamental wave number to a drain electrode (output terminal) of a high-frequency power transistor used, while providing impedance in a short-circuited state to harmonic components (for instance, second harmonic) having even-fold frequencies of a fundamental wave, thereby reducing the power consumption of harmonic components to zero. This enables the high-efficiency operation of the power amplifier. The input impedance characteristics ($S_{11}$) of the two-terminal-pair isolator are substantially short-circuited to a second harmonic in some cases, and the operation of the power amplifier is unstable under such impedance conditions, causing oscillation, etc. Thus, the use of the impedance-adjusting means 90 as a phase circuit can shift a phase θ until the power amplifier and the two-terminal-pair isolator have unconjugated matching, thereby suppressing the oscillation of the power amplifier. For instance, when the inductance element of the impedance-adjusting means 90 is a distribution constant line disposed between the first input/output port P1 and the port PT, the input impedance to second harmonic can be controlled in a desired range by adjusting the length and shape of the distribution constant line.

Figure 17:
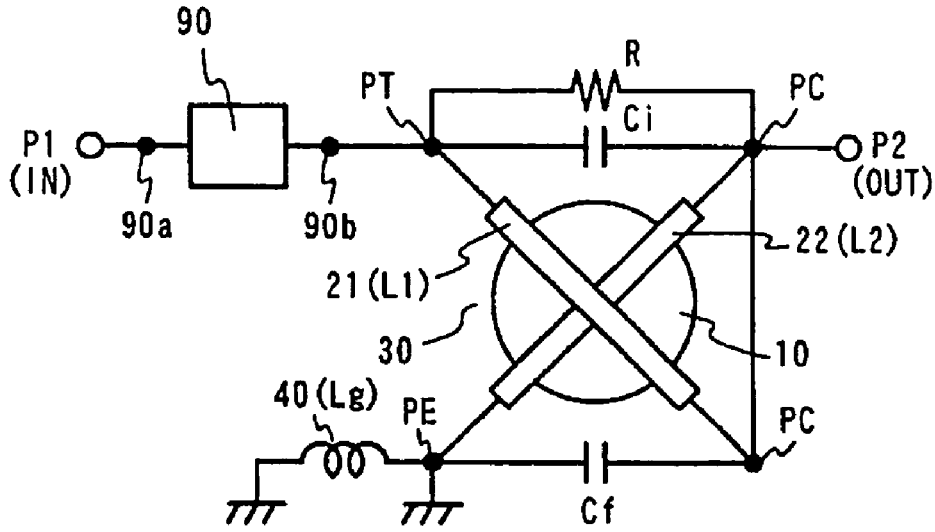
FIG. 17 is a view showing an equivalent circuit of the non-reciprocal circuit device according to another embodiment of the present invention.

Though the large shift of a phase θ can be achieved by elongating the distribution constant line, it is accompanied by the deterioration of electric characteristics. Accordingly, when the phase θ would not be able to be adjusted sufficiently if the impedance-adjusting means 90 were used alone, as shown in FIG. 17, it is preferable to dispose an inductance element 40 between the port PE and the ground. The inductance element 40 can be constituted by a chip inductor or a distribution constant line. The connection of the inductance element 40 to the port PE shifts the phase θ clockwise like in a case where the distribution constant line of the impedance-adjusting means 90 is elongated.

The present invention will be explained in further detail referring to the attached drawings without intention of restricting the scope of the present invention thereto.

EXAMPLE 1

COMPARATIVE EXAMPLE 1

Figure 6:
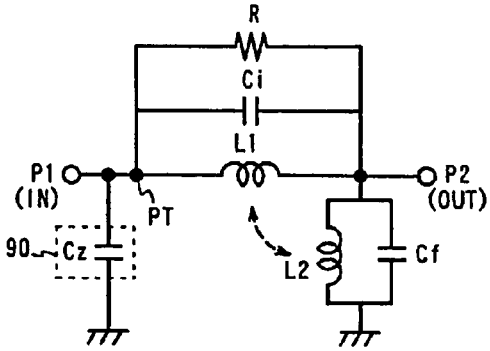
FIG. 6 is a view showing an equivalent circuit of the non-reciprocal circuit device according to one embodiment of the present invention.

FIG. 6 shows an equivalent circuit of the non-reciprocal circuit device according to one embodiment of the present invention. In this embodiment, the impedance-adjusting means 90 is constituted by a capacitance element Cz shunt-connected between the first input/output port P1 and the first inductance element L1 [see FIG. 3(*a*)]. Because the other circuit parts have the same equivalent circuits as shown in FIG. 1, their explanations will be omitted.

Figure 7:
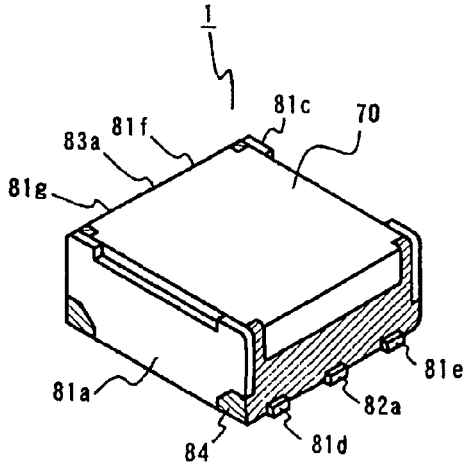
FIG. 7 is a perspective view showing the appearance of the non-reciprocal circuit device according to one embodiment of the present invention.
Figure 8:
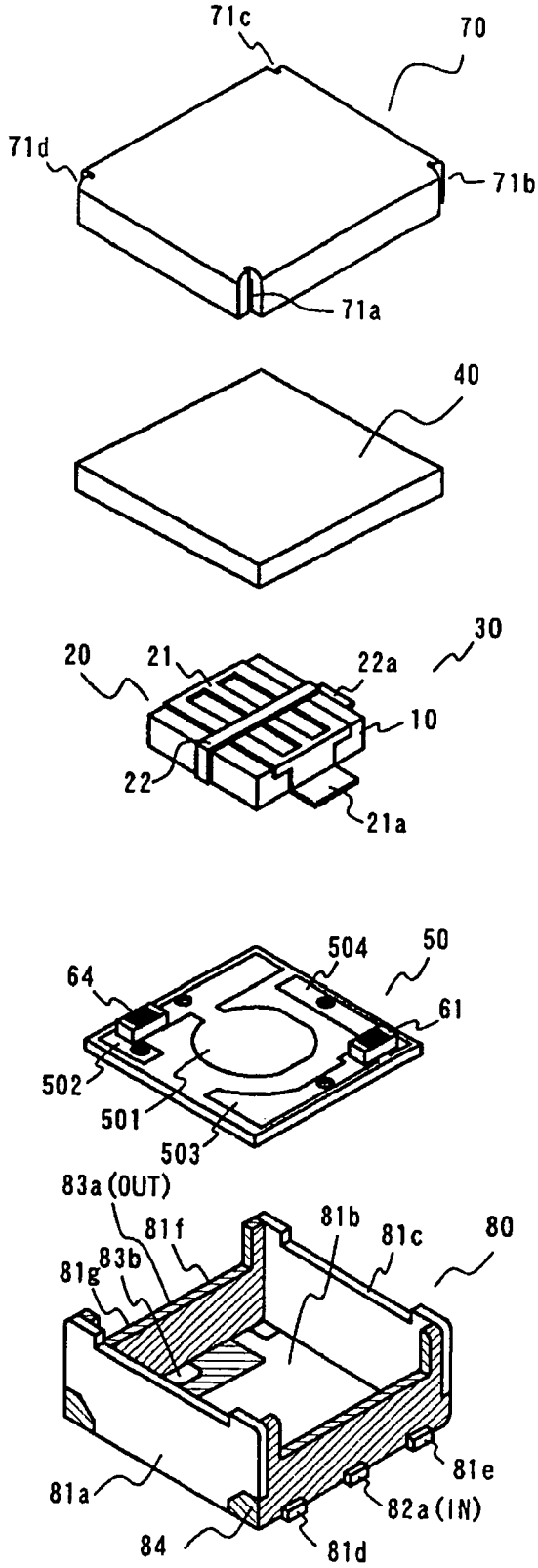
FIG. 8 is an exploded perspective view showing the structure of the non-reciprocal circuit device according to one embodiment of the present invention.

FIG. 7 is a perspective view showing the appearance of the non-reciprocal circuit device according to one embodiment of the present invention, and FIG. 8 is its exploded perspective view. The non-reciprocal circuit device 1 comprises a central conductor assembly 30 comprising a microwave ferrite 10 and a central conductor 20 comprising first and second central conductors 22, 21, which envelop the microwave ferrite 10 such that they are crossing on the microwave ferrite 10 in a mutually insulated state; a laminate substrate 50 comprising first and second capacitance elements Ci, Cf constituting resonance circuits with the first and second central conductors 21, 22; a resin casing 80 provided with an input terminal 82*a* and an output terminal 83*a* connected to the laminate substrate 50; a permanent magnet 40 supplying a DC magnetic field to the microwave ferrite 10; and an upper casing 70 covering the permanent magnet 40, the central conductor assembly 30 and the laminate substrate 50 contained in the resin casing 80.

In the central conductor assembly 30, the first and second central conductors 21, 22 are disposed such that they are crossing via an insulation layer (not shown) on the microwave ferrite 10, which is, for instance, rectangular. Though the first and second central conductors 21, 22 are perpendicular to each other at a crossing angle of 90° in this embodiment, the other crossing angles than 90° are also within the scope of the present invention. In general, the first and second central conductors 21, 22 may be crossing in an angle range of 80°-110°. Because the input impedance of the non-reciprocal circuit device changes depending on the crossing angle, it is preferable to determine a proper crossing angle in cooperation with the impedance-adjusting means, to achieve the optimum impedance matching conditions.

Figure 9A:
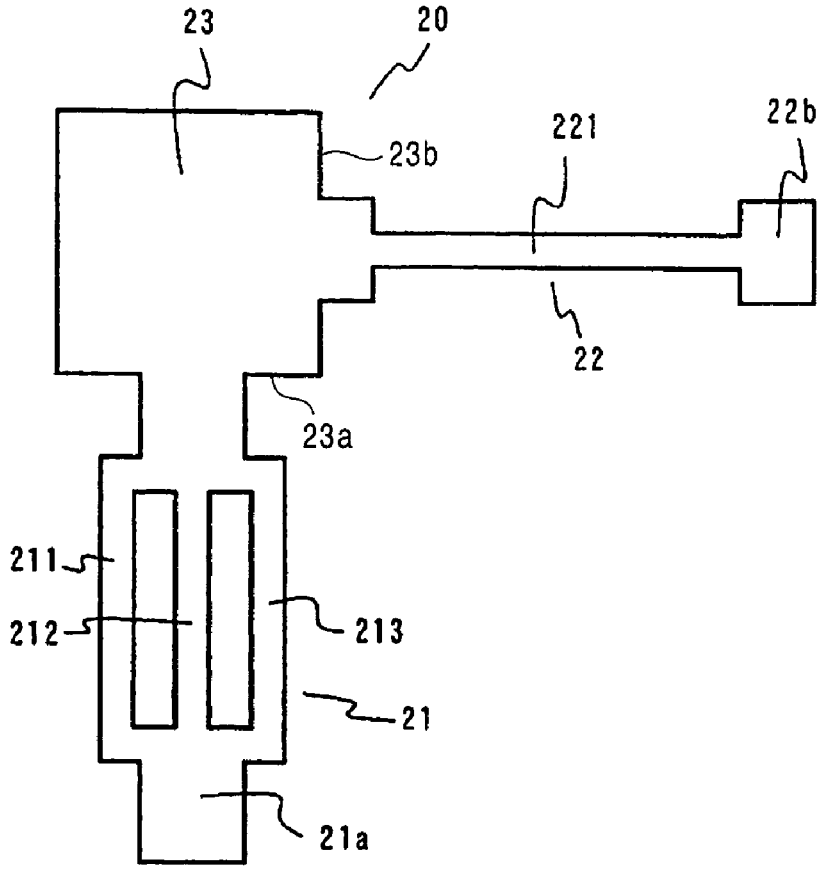
FIG. 9(*a*) is a development showing one example of a central conductor used in the non-reciprocal circuit device according to one embodiment of the present invention.
Figure 9B:
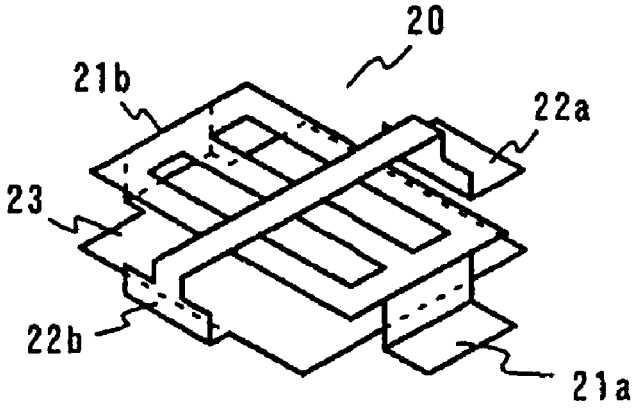

FIG. 9(*a*) is a planar development of the central conductor 20, and FIG. 9(*b*) is a perspective view showing the central conductor 20 disposed on the microwave ferrite 10. The microwave ferrite 10 enveloped by the first and second central conductors 21, 22 are omitted in FIG. 9(*b*), so that a base portion 23 of the central conductor 20 can be seen.

The central conductor 20 has an L-shaped structure as a whole, which integrally comprises the base portion 23, the first central conductor 21 perpendicularly extending from one side 23*a* of the base portion 23, and the second central conductor 22 perpendicularly extending from an adjacent side 23*b* of the base portion 23. Such central conductor 20 can be formed, for instance, from a 30-μm-thick copper plate by punching, etc. The copper plate is preferably plated with silver in a thickness of 1-4 μm, to reduce loss by a skin effect at high frequencies.

The first central conductor 21 has three parallel conductive portions (strips) 211-213, and the second central conductor 22 has one conductive portion (strip) 221. With such structure, the first central conductor 21 has smaller inductance than that of the second central conductor 22.

Because the first and second central conductors 21, 22 of the central conductor 20 envelop the microwave ferrite 10, larger inductance can be obtained than when the central conductor 20 is simply placed on a main surface of the microwave ferrite 10. This largely contributes to the size reduction of the microwave ferrite 10.

The first and second central conductors 21, 22 may be formed by separate copper plates instead of an integral copper plate. The first and second central conductors 21, 22 may also be formed on both surfaces of a flexible, heat-resistant, insulating sheet of polyimide, etc. by a printing method or an etching method. Further, the microwave ferrite 10 may be printed with the first and second central conductors 21, 22. Thus, the first and second central conductors 21, 22 are not restrictive.

The microwave ferrite 10 is not restrictive to be rectangular as shown in the figure, but may be in a disk shape. The rectangular microwave ferrite 10 has a larger volume than the disk-shaped one, resulting in longer first and second central conductors 21, 22 enveloping it and thus larger inductance.

The microwave ferrite 10 may be a magnetic member functioning as a non-reciprocal circuit element to the DC magnetic field supplied from the permanent magnet 40. The preferred magnetic materials include ferrites having a garnet structure, such as yttrium-iron-garnet (YIG), etc., though Ni-ferrite may be used depending on frequencies used. In the case of YIG, part of Y may be substituted by Gd, Ca, V, etc., and part of Fe may be substituted by Al, Ga, etc.

The permanent magnet 40 applying a DC magnetic field to the central conductor assembly 30 is fixed to an inner wall of the upper casing 70 by an adhesive, etc. The permanent magnet 40 is preferably a ferrite magnet [for instance, $(Sr/Ba)O.nFe_2O_3$] from the aspect of cost and compatibility with the microwave ferrite 10 in temperature characteristics. As compared with a ferrite magnet having a composition represented by $(Sr/Ba)O.nFe_2O_3$, a ferrite magnet having a composition represented by $(Sr/Ba)RO.n(FeM)_2O_3$, wherein R is at least one element selected from the group consisting of rare earth elements including Y, which substitutes for part of Sr and/or Ba, and M is at least one element selected from the group consisting of Co, Mn, Ni and Zn, which substitutes for part of Fe, having a magnetoplumbite crystal structure, the R element and/or the M element being added in the form of compounds in a pulverization step after calcination, has a higher magnetic flux density, thereby enabling the reduction of size and thickness of the non-reciprocal circuit device. The ferrite magnet preferably has a residual magnetic flux density Br of 420 mT or more, and a coercivity iHc of 300 kA/m or more.

Figure 10:
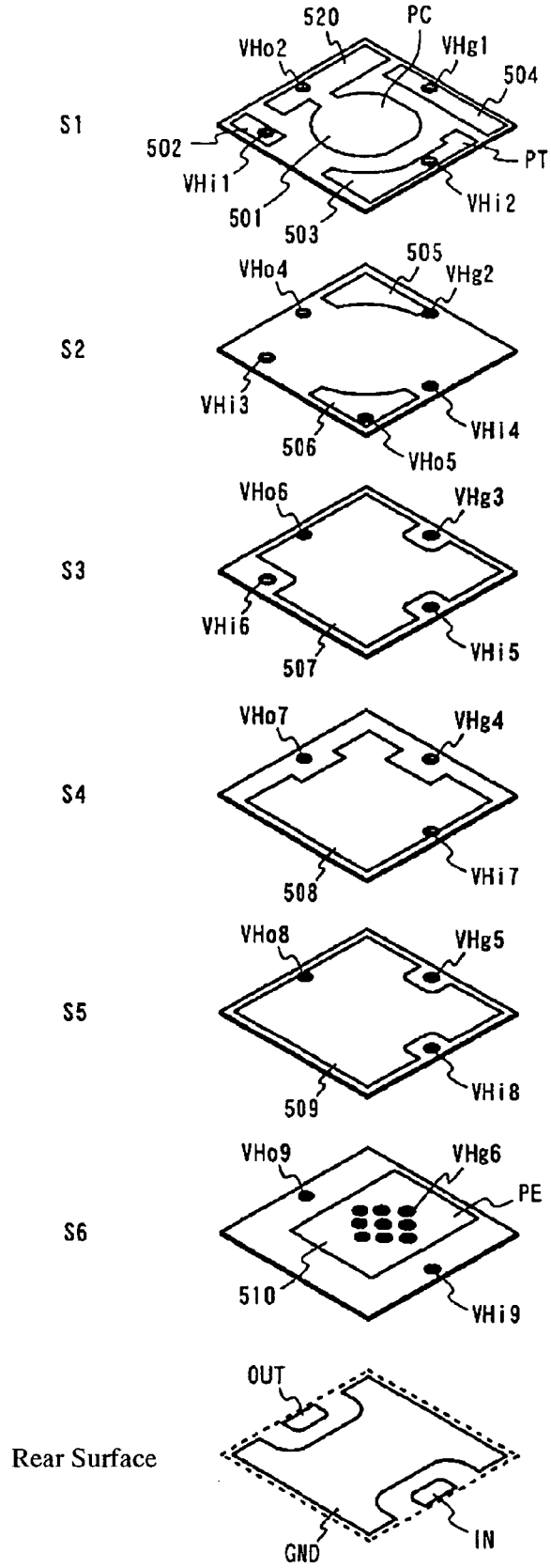
FIG. 10 is an exploded perspective view showing the structure of one example of a laminate substrate used in the non-reciprocal circuit device according to one embodiment of the present invention.

FIG. 10 is an exploded perspective view of the laminate substrate 50. The laminate substrate 50 in this embodiment is constituted by six dielectric sheets S1-S6. Ceramics used for the dielectric sheets S1-S6 are preferably low-temperature-cofirable ceramics (LTCCs), which can be cofired with conductive pastes of Ag, etc.

From the aspect of environment, the LTCCs preferably do not contain lead. Such LTCCs preferably comprise main components comprising 10-60% by mass of Al (as $Al_2O_3$), 25-60% by mass of Si (as $SiO_2$), 7.5-50% by mass of Sr (as SrO), and 0-20% by mass of Ti (as $TiO_2$), at least one auxiliary component selected from the group consisting of 0.1-10% by mass of Bi (as $Bi_2O_3$), 0.1-5% by mass of Na (as $Na_2O$), 0.1-5% by mass of K (as $K_2O$), and 0.1-5% by mass of Co (as CoO), and at least one element selected from the group consisting of 0.01-5% by mass of Cu (as CuO), 0.01-5% by mass of Mn (as $MnO_2$) and 0.01-5% by mass of Ag, based on 100% by mass of the main components.

A ceramic powder mixture having the above composition is calcined at 700-850° C., finely pulverized to an average particle size of 0.6-2 μm, mixed with a binder and a solvent to form a slurry, and formed into dielectric green sheets by a doctor blade method, etc. Each green sheet is provided with via-holes, and printed with a conductive paste to form electrode patterns, with the via-holes filled with the conductive paste. Pluralities of green sheets having electrode patterns are laminated and burned to form an integral laminate substrate 50.

High-conductivity metals such as Ag, Cu, Au, etc. can be used for electrode patterns on the laminate substrate 50 thus formed from the low-temperature-cofirable ceramics. The electrode pattern preferably comprises a lower plating layer of Ag, Cu, Ag—Pd, etc., an intermediate plating layer of Ni, and an upper plating layer of Au. Because the Au plating has good solder wettability and high conductivity, it is effective to reduce the loss of the non-reciprocal circuit device. The electrode pattern is usually as thick as about 2-20 μm, 2 times or more the thickness necessary for a skin effect. Because the laminate substrate 50 is constituted by low-resistance-loss electrode patterns formed on the dielectric sheets having a high Q value, it can provide the non-reciprocal circuit device with extremely small loss.

The laminate substrate 50 is as small as about 4 mm×4 mm or less. It is preferable that a mother sheet of large numbers of the laminate substrates 50 with grooves provided between the substrates 50 is prepared and divided along the grooves, or that the mother sheet is cut by a dicer or a laser. Thus, many laminate substrates 50 can be produced by simple steps.

The burning of the laminate substrate 50 is preferably carried out by a restrained burning method. The restrained burning method comprises sandwiching the laminate substrate 50 with shrinkage-suppressing sheets that are not sintered under the burning conditions of the laminate substrate 50, particularly at a burning temperature of 1000° C. or lower, burning it while suppressing shrinkage in a planar direction (X-Y direction), and then removing the shrinkage-suppressing sheets by an ultrasonic cleaning method, a wet honing method, a blast method, etc. A laminate substrate with little sintering strain is thus obtained. The shrinkage-suppressing sheets are formed by alumina powder, or a mixture of alumina powder and stabilized zirconia powder, etc.

As shown in FIG. 10, the dielectric sheets S1-S6 are printed with a conductive paste for electrode patterns. Specifically, the dielectric sheet S1 is provided with electrode patterns 501-504, 520; the dielectric sheet S2 is provided with electrode patterns 505, 506; the dielectric sheet S3 is provided with an electrode pattern 507; the dielectric sheet S4 is provided with an electrode pattern 508; the dielectric sheet S5 is provided with an electrode pattern 509; and the dielectric sheet S6 is provided with an electrode pattern 510.

The electrode pattern on the dielectric sheets S1-S6 are connected through via-holes VHg1-VHg6, VHi1-VHi9, VHo1-VHo9 filled with the conductive paste. Specifically, the via-holes VHg1-VHg6 connect the electrode patterns 504, 505, 510 to a ground electrode GND; the via-holes VHi1-VHi9 connect the electrode pattern 502 to an input terminal IN via the electrode pattern 508; and the via-holes VHo1-VHo9 connect the electrode patterns 520, 507, 509 to an output terminal OUT. the electrode patterns 503, 506, 507, 508, 509 constitute the first capacitance element Ci, and the electrode patterns 520, 505, 507 and the electrode patterns 509, 510 constitute the second capacitance element Cf.

In this embodiment, the electrode patterns constituting the first and second capacitance elements Ci, Cf are formed on pluralities of layers, and connected in parallel through via-holes. With such structure, an electrode pattern having a large area can be formed on one layer. Specifically, the capacitance of about 30 pF can be obtained.

Pluralities of electrode patterns formed on the dielectric sheet S1 appear on the main surface of the laminate substrate. A chip capacitor 61 functioning as the impedance-adjusting circuit 90 is soldered to the electrode patterns 503, 504, and a chip resistor 64 is soldered to the electrode patterns 502, 520. A base portion 23 of the central conductor 20 is soldered to a substantially circular electrode pattern 501. The electrode pattern 501 is substantially circular in this embodiment, to have the maximum insulation distance from the electrode patterns 502, 503, 504 around the electrode pattern 501 while securing a large area for them. The electrode pattern 503 is connected to an end 21*a* of the first central conductor 21 by soldering, etc., and the electrode pattern 504 is connected to the other end 22*a* of the second central conductor 22 by soldering, etc.

The laminate substrate 50 is provided with an input terminal IN and an output terminal OUT on both sides of the ground electrode GND on a rear surface. The ground electrode GND is connected to a bottom portion 81*b* of the frame 81 in the insert-molded resin casing 80 by soldering, etc. The input terminal IN and the output terminal OUT are respectively connected to exposed ends of input and output terminals 82*b*, 83*b* embedded in the resin casing 80 by soldering, etc.

Figure 11:
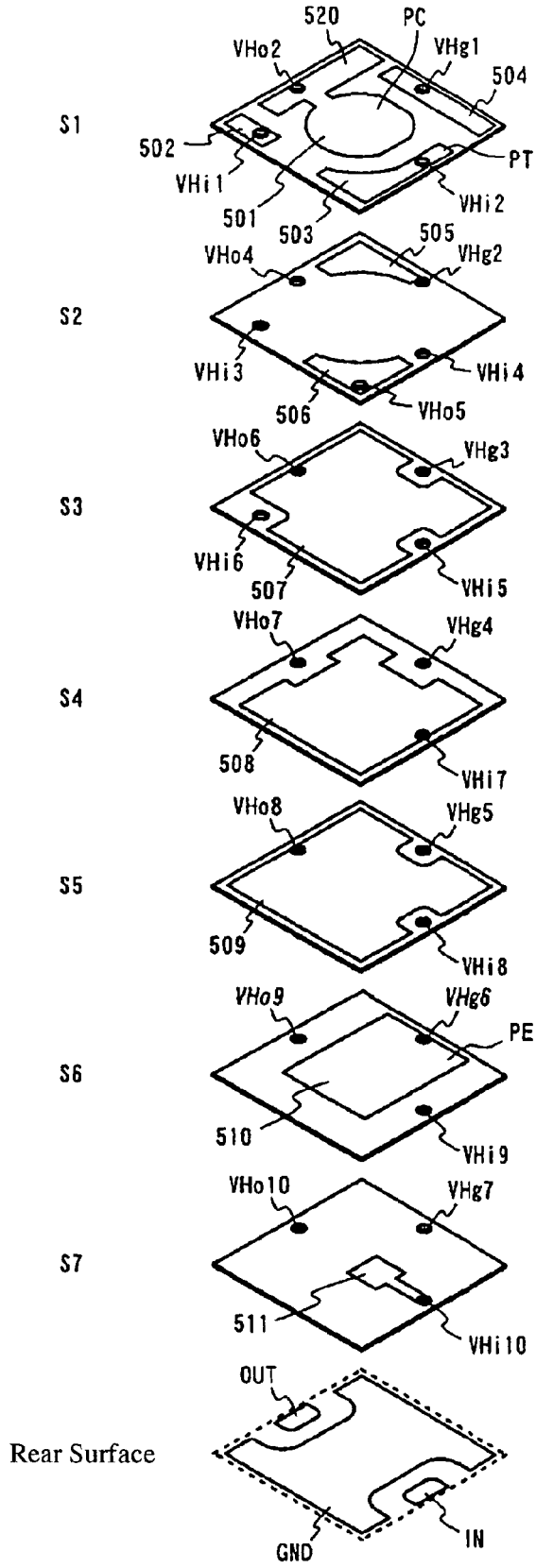
FIG. 11 is an exploded perspective view showing the structure of another example of a laminate substrate used in the non-reciprocal circuit device according to one embodiment of the present invention.

In this embodiment, a capacitance element Cin for the impedance-adjusting means 90 is a chip capacitor 61 mounted onto the main surface of the laminate substrate 50. Because a desired chip capacitor can be selected, the input impedance is easily adjustable. As shown in FIG. 11, the capacitance element Cin of the impedance-adjusting means 90 may be formed by the electrode pattern 511 in the laminate substrate 50. In the example shown in FIG. 11, the capacitance element Cin is formed on the dielectric sheet S7, and the electrode pattern 510 formed on the dielectric sheet S6 and the ground electrode GND formed on the dielectric sheet S7 constitute a capacitance element Cz, thereby making a chip capacitor unnecessary. With a capacitance element formed in the laminate substrate 50 and a chip capacitor mounted onto the laminate substrate 50, the capacitance of the impedance-adjusting means 90 can be adjusted.

In the non-reciprocal circuit device of the present invention, the impedance-adjusting means 90 may be constituted by an inductance element alone or by a combination of an inductance element and a capacitance element. The inductance element may be a chip inductor, or an electrode pattern (line pattern) formed on a dielectric sheet.

When the inductance element and the capacitance element for the impedance-adjusting means 90 are formed by electrode patterns, their adjustment is difficult without resorting to trimming. However, when a chip capacitor and a chip inductor are used, capacitance and inductance can be finely adjusted such that good impedance matching is achieved.

A substantially box-shaped upper casing 70 fixed to side walls 81*a*, 81*c* of a metal frame 81 in the insert-molded resin casing 80 is made of a ferromagnetic material such as soft iron, etc., so that it can function as a magnetic yoke forming a magnetic circuit surrounding the permanent magnet 40, the central conductor assembly 30 and the laminate substrate 50. The upper casing 70 is preferably plated with at least one metal selected from the group consisting of Ag, Au, Cu and Al, or its alloy. The electric resistivity of the plating layer is preferably 5.5 μΩμcm or less, more preferably 3.0 μΩcm or less, most preferably 1.8 μΩcm or less. The thickness of the plating layer is preferably 0.5-25 μm, more preferably 0.5-10 μm, most preferably 1-8 μm. With such structure, loss can be reduced while suppressing interference with external circuits.

Figure 12:
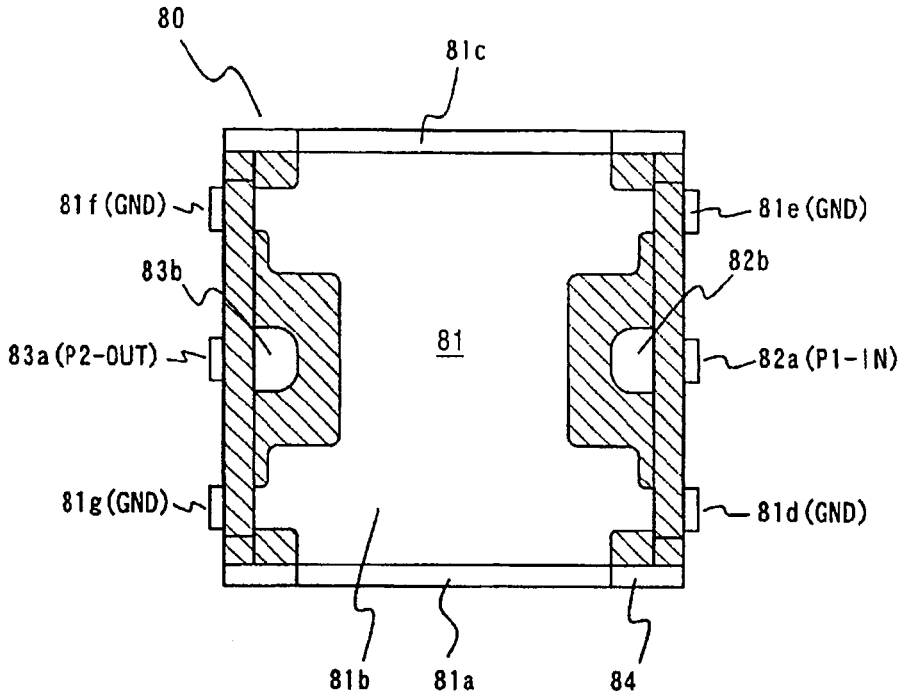
FIG. 12 is a plan view showing a resin casing used in the non-reciprocal circuit device according to one embodiment of the present invention.

FIG. 12 is a plan view showing the resin casing 80. The insert-molded resin casing 80 comprises as thin a metal frame 81 as about 0.1 mm. The metal frame 81 is formed from a metal plate by punching, etching, etc., integrally having a bottom portion 81*b*, two side walls 81*a*, 81*c* on both sides thereof, and terminals 81*d*-81*g*. The frame terminals 81*d*-81*g* are ground terminals. The frame side walls 81*a*, 81*c* oppose the side wall of the upper casing 70 to uniformly supply a magnetic flux from the permanent magnet 40 to the central conductor assembly 30.

The resin casing 80 is integrally provided with an input terminal 82*a* (first input/output port P1 of the IN-equivalent circuit) and an output terminal 83*a* (second input/output port P2 of the OUT-equivalent circuit). The frame bottom portion 81*b* is separate from an exposed end 82*b* of the input terminal IN and an exposed end 83*b* of the output terminal OUT by about 0.3 mm, to secure electric insulation from the input terminal IN and the output terminal OUT.

The frame 81 is formed, for instance, by an SPCC (JIS G3141) sheet having a thickness of about 0.15 mm, which has a Cu plating as thick as 1-3 μm and an Ag plating as thick as 2-4 μm. With such plating, the high-frequency characteristics are improved.

With the resin casing 80 contained in the laminate substrate 50, the input terminal IN and the output terminal OUT of the laminate substrate 50 are respectively soldered to the exposed end 82*b* of the input terminal and the exposed end 83*b* of the output terminal in the resin casing 80. The bottom ground GND of the laminate substrate 50 is soldered to the frame bottom portion 81*b* of the resin casing 80.

Because the resin casing shown in FIG. 12 has four ground terminals 81*d*-81*g* (GNDs), a ground potential can be obtained surely and stably. Further, because soldering is made at six points including the input terminal IN and the output terminal OUT, the non-reciprocal circuit device has high mounting strength.

Instead of soldering both frame side walls 81*a*, 81*c* of the resin casing 80 to the upper casing 70, it is preferable to solder only one of them to the upper casing 70 or to adhere both to the upper casing 70. If both frame side walls 81*a*, 81*c* are soldered to the upper casing 70, insertion loss may be deteriorated. This is because a high-frequency current loop is formed in the upper casing 70 to generate a high-frequency magnetic field, which adversely affects the central conductor assembly 30.

As a specific example, a microwave ferrite 10 of garnet having a diameter of 1.9 mm and a thickness of 0.35 mm, a permanent ferrite magnet 40 having a length of 2.8 mm, a width of 2.5 mm and a thickness of 0.4 mm, and first and second central conductors 21, 22 integrally formed from a 30-μm-thick, L-shaped Cu plate having a semi-gloss Ag plating having a thickness of 1-4 μm by etching were used, to produce an extremely small, rectangular non-reciprocal circuit device of 3.2 mm each for frequencies of 830-840 MHz in the same manner as above. The first central conductor 21 having a total width of 1.0 mm was constituted by three 0.2-mm-wide, parallel strips with a gap of 0.2 mm. The second central conductor 22 was constituted by one 0.2-mm-wide strip. A chip resistor of 70 Ω as a dummy resistor was soldered to the laminate substrate 50. A chip capacitor of 1 pF as the impedance-adjusting means was soldered to the laminate substrate 50, such that it was connected between the first input/output port P1 and a ground.

The non-reciprocal circuit device thus produced was measured by a network analyzer at frequencies of 785-885 MHz, with respect to an $S_{11}$ Smith chart, input reflection loss, insertion loss and isolation. For comparison, the same measurement was conducted on a non-reciprocal circuit device having the same structure as above except that a chip capacitor as a means for matching input impedance was not connected.

Figure 13:
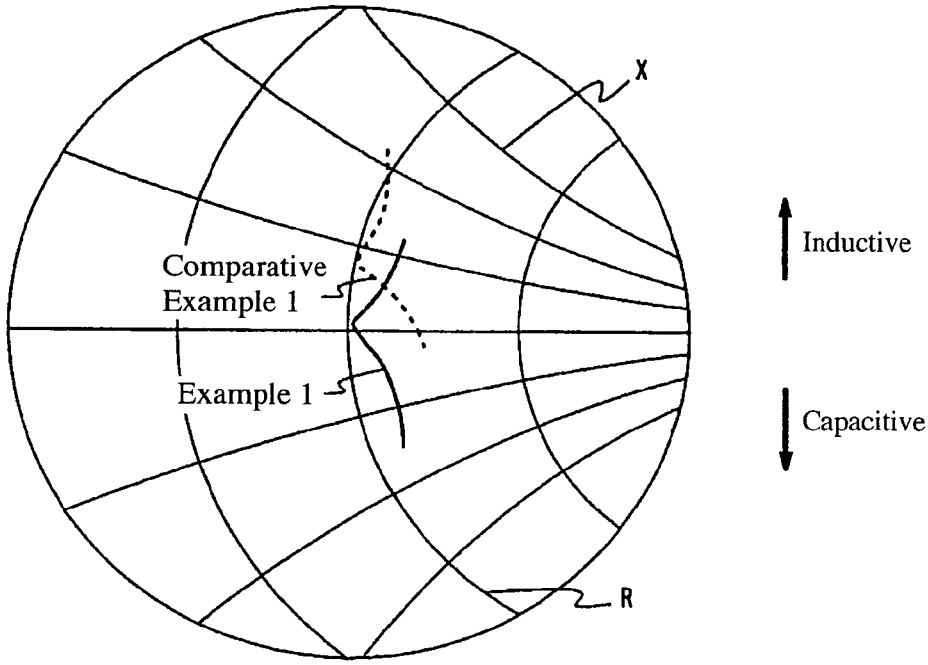
FIG. 13 is an $S_{11}$ Smith chart of the non-reciprocal circuit devices of Example 1 and Comparative Example 1.

FIG. 13 is an $S_{11}$ Smith chart showing the reflection characteristics of the first input/output port P1. This $S_{11}$ Smith chart shows the ratio of reflected waves to incident waves on the side of the first input/output port P1 when the second input/output port P2 was terminated at a characteristic impedance of 50 Ω. It was confirmed from the $S_{11}$ Smith chart that while Comparative Example 1 showed an inductive impedance of (50+j 11) Ω at a center frequency of 835 MHz, Example 1 showed impedance of (50+j 0.3) Ω, which was 50 Ω with an extremely small imaginary part, thereby achieving good impedance matching.

Figure 14:
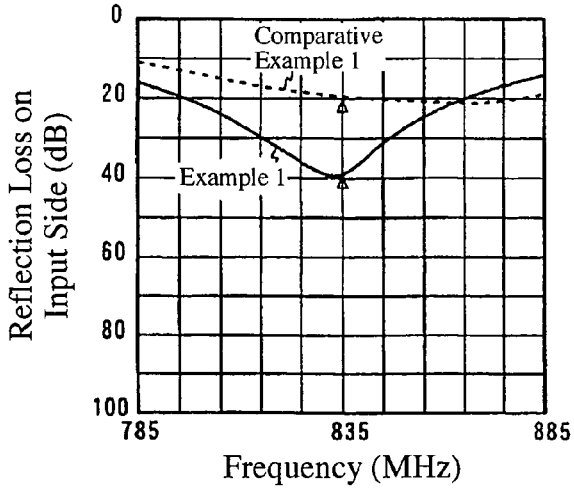
FIG. 14 is a graph showing the frequency characteristics of reflection loss on the input side in the non-reciprocal circuit devices of Example 1 and Comparative Example 1.
Figure 15:
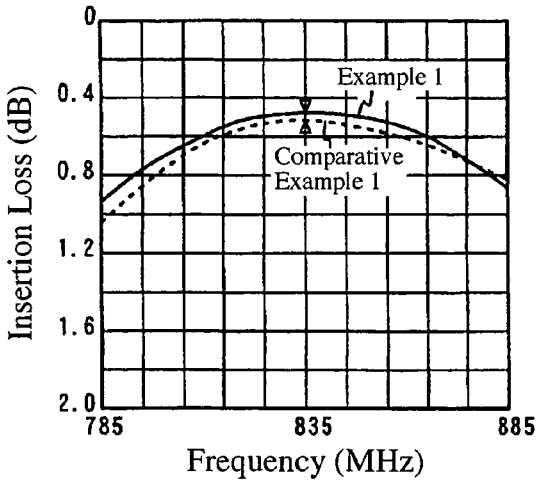
FIG. 15 is a graph showing the frequency characteristics of insertion loss of the non-reciprocal circuit devices of Example 1 and Comparative Example 1.
Figure 16:
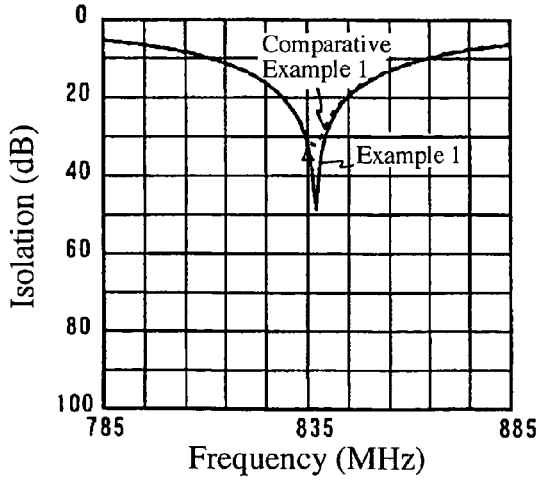
FIG. 16 is a graph showing the frequency characteristics of isolation of the non-reciprocal circuit devices of Example 1 and Comparative Example 1.

FIG. 14 shows the frequency characteristics of reflection loss on the side of the first input/output port P1. While the reflection loss at a center frequency of 835 MHz was 19 dB in Comparative Example 1, it was remarkably improved to 39 dB in Example 1. FIG. 15 shows the frequency characteristics of insertion loss. While the insertion loss of the non-reciprocal circuit device at a center frequency of 835 MHz was 0.52 dB in Comparative Example 1, it was improved to 0.45 dB in Example 1. As shown in FIG. 16, the isolation characteristics were good in both Example 1 and Comparative Example 1, with substantially no difference.

Though a capacitance element was used for the impedance-adjusting circuit 90 in this Example, the present invention is of course not restricted thereto. Though impedance was in an upper half (inductive) of the $S_{11}$ Smith chart shown in FIG. 13 in Comparative Example 1, the imaginary part of the impedance was changed to provide an input impedance of 50 Ω by the capacitance element Cz having capacitive impedance in Example 1. When the input impedance is in a lower half of the $S_{11}$ Smith chart (R−jX), its imaginary part can be corrected by an inductance element having inductive impedance.

EXAMPLE 2

Figure 18:
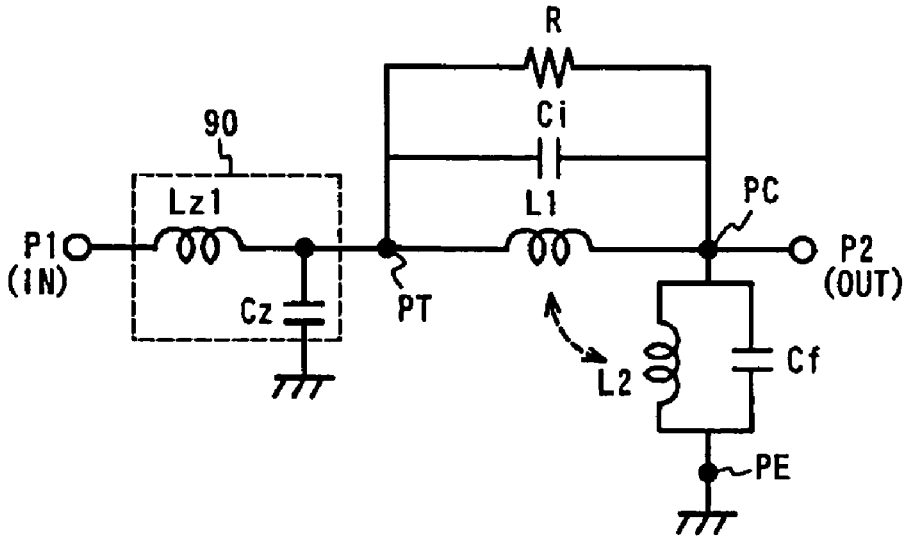
FIG. 18 is a view showing an equivalent circuit of the non-reciprocal circuit device according to a further embodiment of the present invention.
Figure 19:
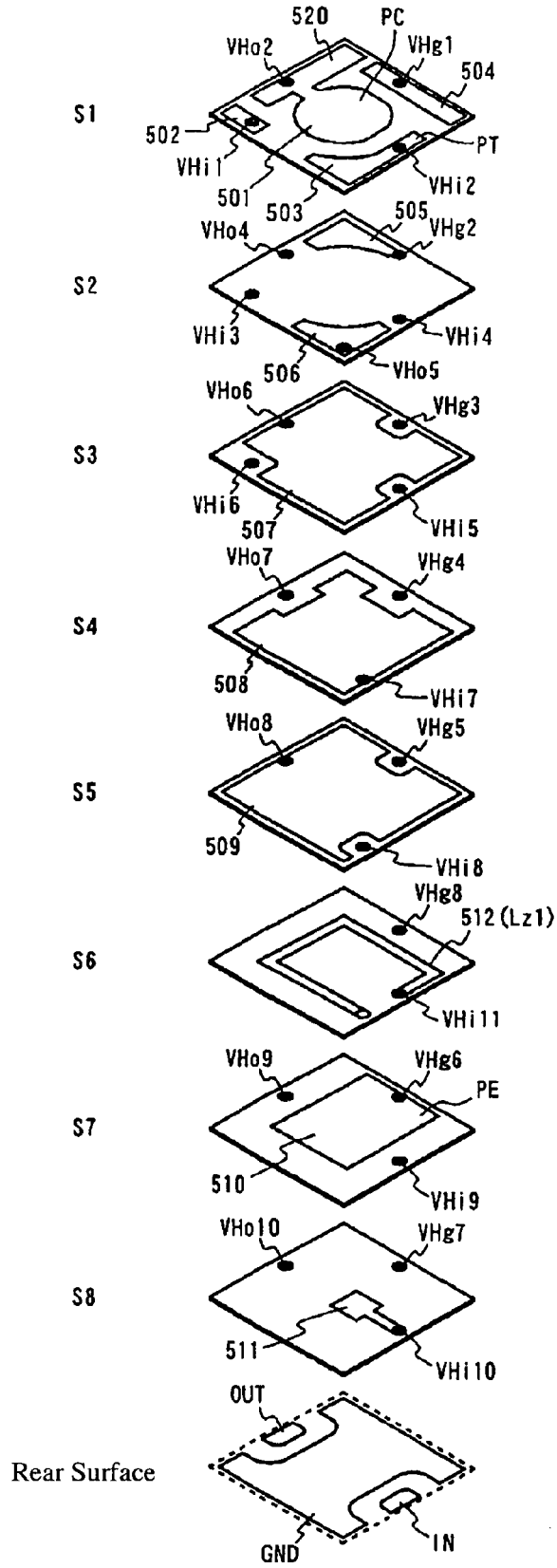
FIG. 19 is an exploded perspective view showing the structure of a laminate substrate used in the non-reciprocal circuit device according to a further embodiment of the present invention.
Figure 20:
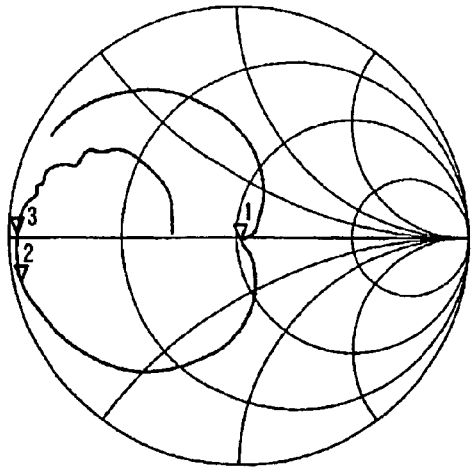
FIG. 20 is an $S_{11}$ Smith chart of the non-reciprocal circuit device of Example 2, to which an inductance element was not connected.
Figure 21:
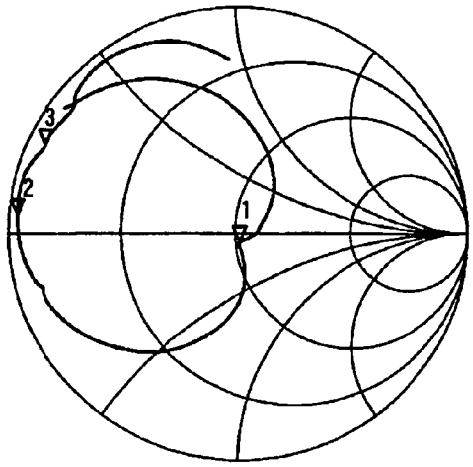
FIG. 21 is an $S_{11}$ Smith chart of the non-reciprocal circuit device of Example 2.

FIG. 18 shows an equivalent circuit of the non-reciprocal circuit device according to another embodiment of the present invention. The difference from Example 1 is that the impedance-adjusting circuit 90 was constituted by a capacitance element Cz, and an inductance element Lz1 series-connected between the first input/output port P1 and the port PT. The inductance element Lz1 is, for instance, in FIG. 19, a distribution constant line formed by the electrode pattern 512 formed on the dielectric sheet S6. FIG. 20 is an $S_{11}$ Smith chart when the inductance element Lz1 was not connected to the non-reciprocal circuit device of Example 2, and FIG. 21 is an $S_{11}$ Smith chart of Example 2. In the $S_{11}$ Smith charts, marks 1-3 show frequencies of 835 MHz, 1.68 GHz and 2.52 GHz, respectively. With the inductance element Lz1 connected, the phase θ of harmonic components (1.68 GHz: second harmonic, 2.52 GHz: third harmonic) can be shifted without substantially changing the matching conditions of a fundamental wave (835 MHz). Accordingly, the conjugated matching of the power amplifier and the two-terminal-pair isolator can be prevented, thereby suppressing the oscillation of the power amplifier.

EXAMPLE 3

Figure 22:
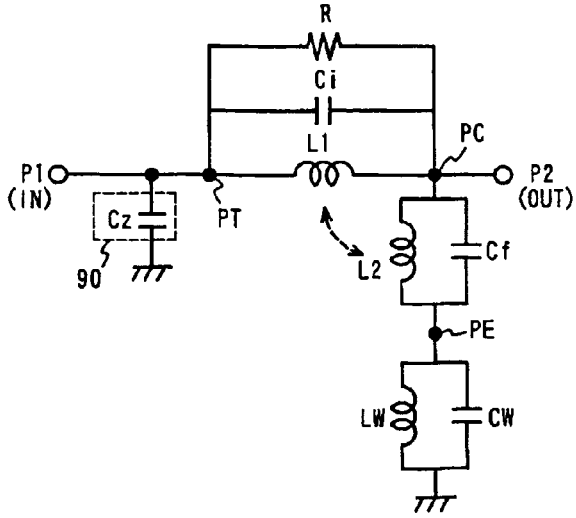
FIG. 22 is a view showing an equivalent circuit of the non-reciprocal circuit device according to a further embodiment of the present invention.

FIG. 22 shows an equivalent circuit of the non-reciprocal circuit device according to a further embodiment of the present invention. The difference from Example 1 is that a parallel resonance circuit of a fourth inductance element LW and a fourth capacitance element CW was connected between the port PE and a ground. This non-reciprocal circuit device can provide a wider passband than those of the other non-reciprocal circuit devices.

Figure 23:
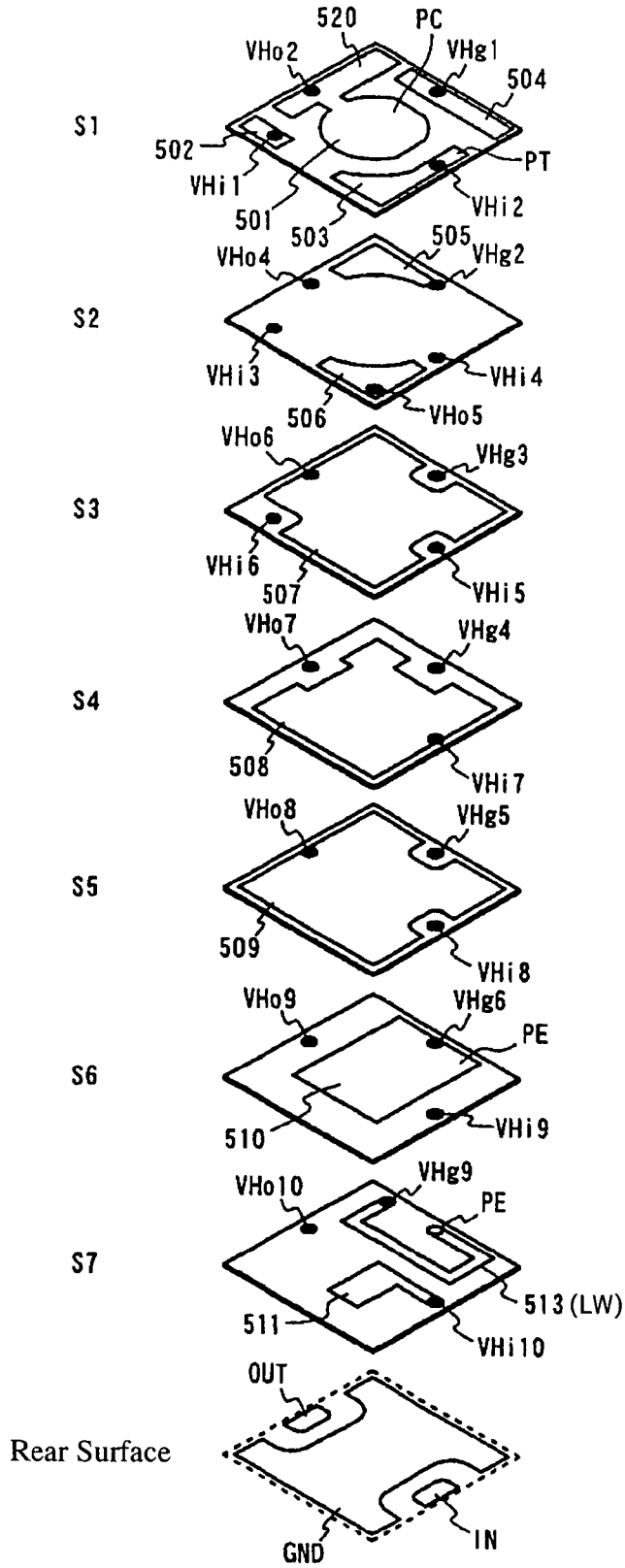
FIG. 23 is an exploded perspective view showing the structure of a laminate substrate used in the non-reciprocal circuit device according to a further embodiment of the present invention.
Figure 24:
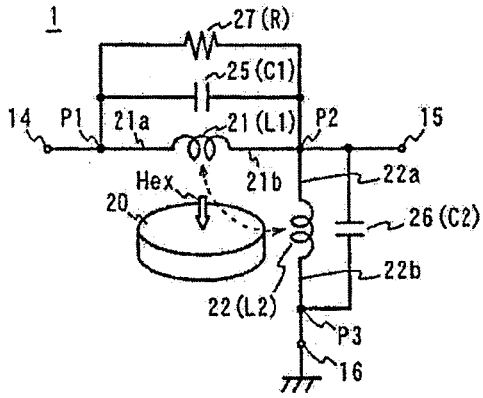
Fig. 24 PRIOR ART
FIG. 24 is a view showing an equivalent circuit of a conventional non-reciprocal circuit device.
Figure 25:
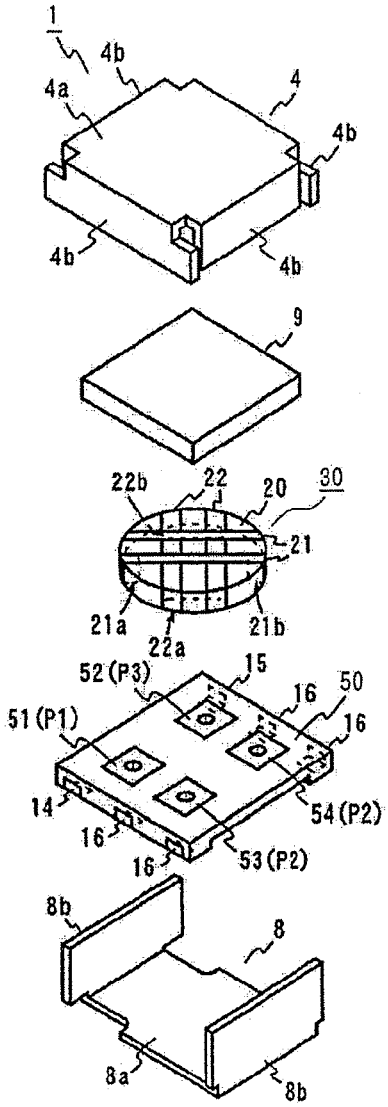
Fig. 25 PRIOR ART
FIG. 25 is an exploded perspective view showing a conventional non-reciprocal circuit device.
Figure 26:
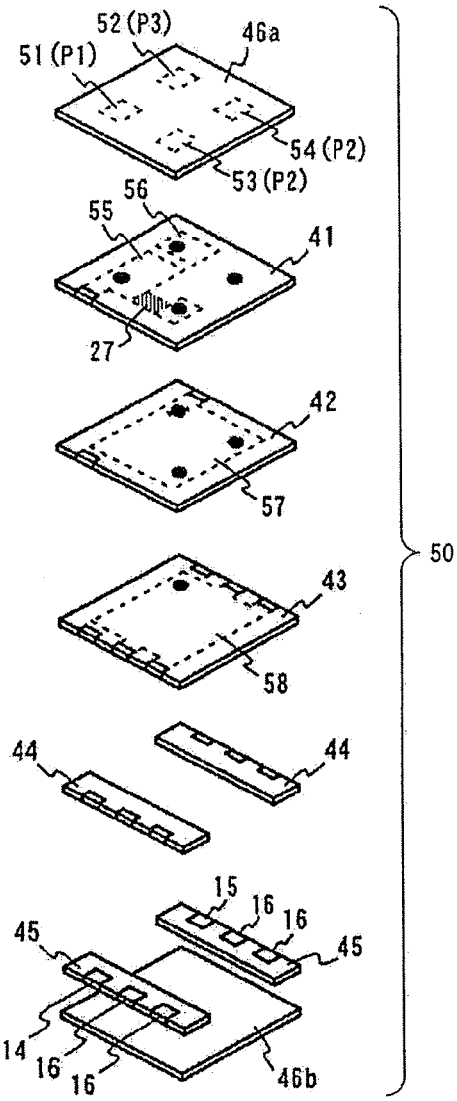
Fig. 26 PRIOR ART
FIG. 26 is an exploded perspective view showing the structure of a laminate substrate used in the conventional non-reciprocal circuit device.
Figure 27:
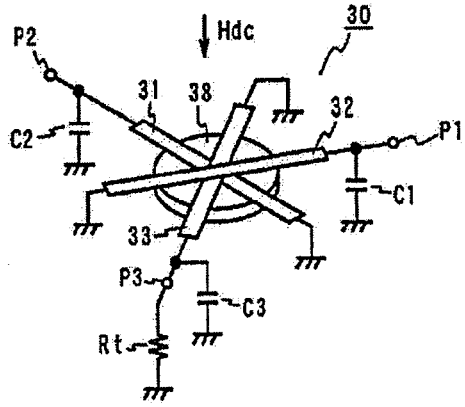
Fig. 27 PRIOR ART
FIG. 27 is a view showing an equivalent circuit of another example of the conventional non-reciprocal circuit device.

In the example shown in FIG. 23, to reduce the size of the non-reciprocal circuit device without increasing the number of mounted parts, the inductance element LW was constituted by a distribution constant line formed by the electrode pattern 513 formed on the dielectric sheet S7, and the capacitance element CW was formed by an electrode pattern 510 formed on the dielectric sheet S6 and an electrode pattern GND on a rear surface, both being contained in the laminate substrate. However, the inductance element LW and the capacitance element CW may be parts mounted onto the laminate substrate.

EFFECT OF THE INVENTION

The non-reciprocal circuit device of the present invention comprising an impedance-adjusting means between a first input/output port and a first inductance element is provided with an easily adjustable input impedance without losing good insertion loss and isolation characteristics. Accordingly, when it is disposed between a power amplifier and an antenna in a transmission part of mobile communications equipment, it can not only prevent unnecessary signals from flowing back to the power amplifier, but also stabilize the impedance of the power amplifier on a load side. Thus, the use of the non-reciprocal circuit device of the present invention can increase battery life in cell phones, etc.

What is claimed is:

1. A non-reciprocal circuit device comprising:

a first inductance element disposed between a first input/output port and a second input/output port, a second inductance element disposed between said second input/output port and a ground, a first capacitance element constituting a first parallel resonance circuit with said first inductance element, a second capacitance element constituting a second parallel resonance circuit with said second inductance element, a resistance element parallel-connected to said first parallel resonance circuit, and an impedance-adjusting means disposed between said first input/output port and said first inductance element, said impedance adjusting means being constituted by a third inductance element and/or a third capacitance element, wherein said first inductance element and said second inductance element are formed by a first central conductor and a second central conductor disposed on a ferrimagnetic member, said first central conductor having a smaller inductance than that of said second central conductor.

2. The non-reciprocal circuit device according to claim 1, wherein said impedance-adjusting means is a lowpass or highpass filter, which removes harmonic signals.

3. The non-reciprocal circuit device according to claim 1, wherein an impedance of said first inductance element is inductive when viewed from said first input/output port, and wherein a capacitance element is disposed as said impedance-matching means between said first input/output port and the ground.

4. The non-reciprocal circuit device according to claim 1, wherein at least part of said first or second capacitance element is formed by an electrode pattern in a laminate substrate.

5. The non-reciprocal circuit device according to claim 1, wherein said first central conductor has a plurality of parallel conductive portions, and said second central conductor has only one conductive portion.

6. The non-reciprocal circuit device according to claim 5, wherein a third inductance element and/or a third capacitance element for said impedance-adjusting means is constituted by an electrode pattern in a laminate substrate or an element mounted onto said laminate substrate.

7. The non-reciprocal circuit device according to claim 1, wherein it further comprises a fourth inductance element between said second parallel resonance circuit and the ground.

8. The non-reciprocal circuit device according to claim 7, wherein it comprises a fourth capacitance element in parallel with said fourth inductance element between said second parallel resonance circuit and the ground.

* * * * *